US006254293B1

(12) United States Patent
Citrenbaum

(10) Patent No.: US 6,254,293 B1
(45) Date of Patent: Jul. 3, 2001

(54) WRITING INSTRUMENT AND HAND TOOL GRIP

(76) Inventor: Mathew Citrenbaum, 11400 Bustleton Ave., Philadelphia, PA (US) 19116

( * ) Notice: Subject to any disclaimer, the term of this patent is extended or adjusted under 35 U.S.C. 154(b) by 0 days.

(21) Appl. No.: 09/536,135

(22) Filed: Mar. 28, 2000

(51) Int. Cl.[7] ..... A46B 5/02
(52) U.S. Cl. ..... 401/6; 401/7; 30/340
(58) Field of Search ..... 401/6–8; 30/340, 30/342, 329

(56) References Cited

U.S. PATENT DOCUMENTS

| | | | | |
|---|---|---|---|---|
| D. 228,418 | * | 9/1973 | Locke | 401/6 |
| D. 269,357 | | 6/1983 | Jagger . | |
| D. 298,439 | | 11/1988 | Rusk . | |
| D. 396,057 | | 7/1998 | Bistrack . | |
| 770,716 | | 9/1904 | Engel . | |
| 880,510 | | 3/1908 | Delashaw . | |
| 1,342,576 | * | 6/1920 | Wride | 401/6 |
| 4,526,547 | * | 7/1985 | Rusk | 401/6 |
| 4,832,604 | | 5/1989 | Rusk . | |
| 5,143,463 | | 9/1992 | Pozil et al. . | |
| 5,626,430 | | 5/1997 | Bistrack . | |

* cited by examiner

*Primary Examiner*—Gregory L. Huson
*Assistant Examiner*—Tuan Nguyen
(74) *Attorney, Agent, or Firm*—Akin, Gump, Strauss, Hauer & Feld, L.L.P.

(57) ABSTRACT

A writing instrument and tool holding grip for receiving a hand-held instrument that includes a body. The body includes a shaft-receiving portion. The shaft-receiving portion has an opening for receiving the hand held instrument. A forefinger grip is also included as part of the grip. The forefinger grip is convex from a proximal end to a distal end and projects outwardly from the shaft. The distal end is shaped to orient a forefinger outwardly and to expand skin around a first joint of the forefinger, as the hand drapes over the hand-held instrument while reorienting points of pressure for comfort and maximum control ability.

16 Claims, 2 Drawing Sheets

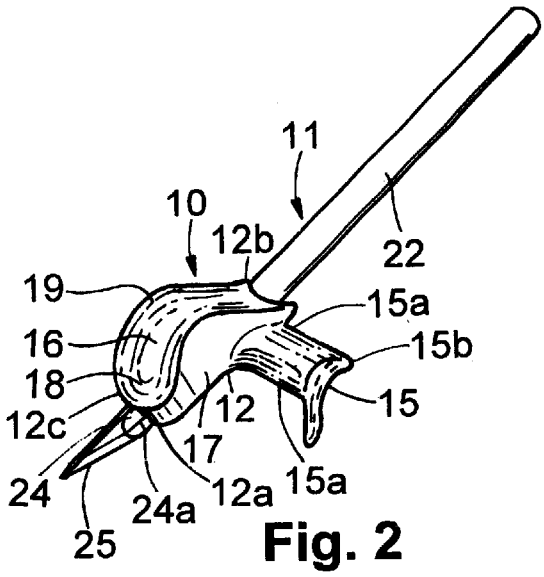
Fig. 2
Fig. 1
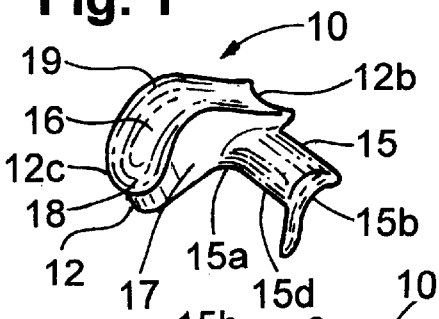
Fig. 4
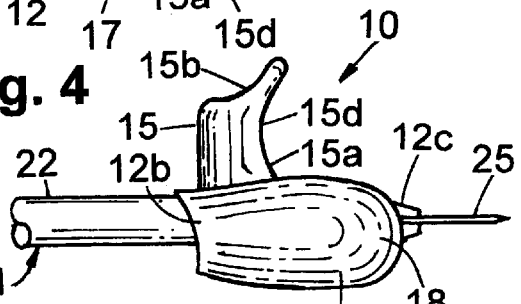
Fig. 5
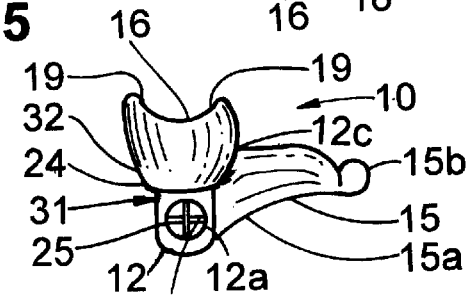
Fig. 6
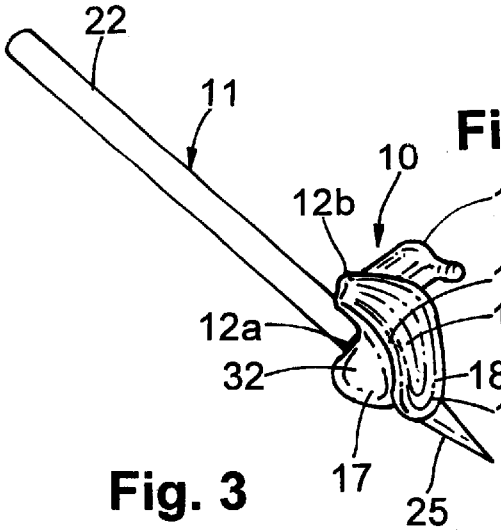
Fig. 3
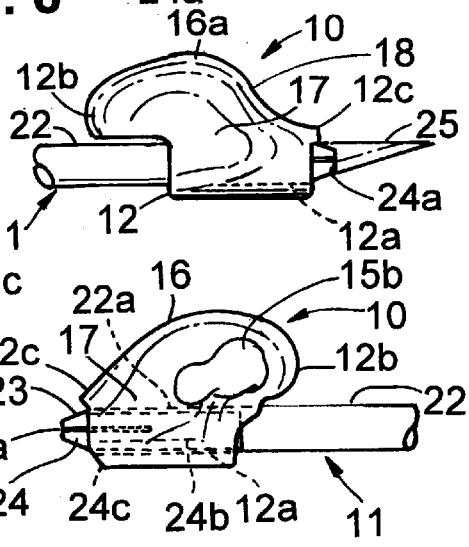
Fig. 7

WRITING INSTRUMENT AND HAND TOOL GRIP

BACKGROUND OF THE INVENTION

The present invention relates generally to an apparatus for receiving writing instruments and hand tools and, more particularly, to a writing instrument and hand tool grip for holding hand-held instruments, such as a writing pen, an xacto™ knife and the like.

One of the challenges facing the manufacturers of writing instruments and hand tools ("hand-held instrument") is to produce a hand-held instrument that is anatomically correct and ergonomic. That is, a hand-held instrument that can conform with the various sizes and degrees to which a user can hold such an instrument, with the objective of providing maximum comfort to the user. One way of resolving this problem, other than producing an anatomically correct writing instrument, is to utilize a grip that holds the hand-held instrument and adapts and rearranges the user's hand to avoid discomfort. These grips are typically available in various sizes. A conventional hand-held instrument grip includes a central bore that receives the hand-held instrument tool, and further includes several external gripping surfaces conforming to the shape of the user's hand. The user inserts the hand-held instrument into the central bore and secures the instrument within the bore. Thereafter, the hand-held instrument is held with the aid of the grip, which reorients the user's fingers to avoid discomfort. Typically, such hand-held instruments include writing instruments and cutting instruments, such as an xacto™ knife well known in the art for its cutting functionality. It is well known that extended use of an xacto™ knife can cause a condition known as "bent finger" syndrome. This condition results from the compression of the skin in the area of the outermost finger joints and eventually causes the development of calluses around the affected areas, particularly for users performing repetitive manual operations This can further create problems with finger strain as well as backward/forward hyperextension of the last or terminal joint of the forefinger with continued use. This is likely due to the fact that the terminal joint of the forefinger does not sit in a natural position causing the joint to dislocate slightly, thus creating pain and discomfort.

Conventional grips are unable to resolve the aforementioned problems. Conventional grips further suffer from the inability to allow a large range of control with a knife blade, so that making left or right bevel cuts, straight line cuts and curved cuts are relatively difficult. There is a need to resolve the aforementioned problems related to hand-held writing instruments, and the present invention meets this need.

BRIEF SUMMARY OF THE INVENTION

Briefly stated, the invention relates to a writing instrument and hand tool grip for receiving a hand-held instrument. The grip includes a body having a shaft-receiving portion with an opening defined therethrough. The opening is adapted to receive the hand-held instrument. A forefinger grip is located above the shaft receiving portion. The forefinger grip is convex from a proximal end to a distal end and projects outwardly from the shaft. The distal end is shaped to orient a forefinger outwardly and expand skin around a first joint of the forefinger as the hand-held instrument is gripped. A thumb support surface is located on a thumb side of the body. The thumb support surface extends downwardly from an upper edge of the forefinger grip.

BRIEF DESCRIPTION OF THE SEVERAL VIEWS OF THE DRAWINGS

The foregoing summary, as well as the following detailed description, will be better understood when read in conjunction with the appended drawings. For the purpose of illustrating the invention there is shown an embodiment which is presently preferred, it being understood, however, that this invention is not limited to the precise arrangement and instrumentalities shown. In the drawings:

FIG. 1 a right-side perspective view of a writing instrument and hand tool grip according to the present invention;

FIG. 2 is a left-side perspective view of the writing instrument and hand tool grip shown in FIG. 1 according to the present invention gripping a hand-held instrument;

FIG. 3 is a right-side perspective view of the writing instrument and hand tool grip of FIG. 2;

FIG. 4 is a partial top plan view of the writing instrument and hand tool grip of FIG. 2;

FIG. 5 is a partial front elevational view of the writing instrument and hand tool grip of FIG. 2;

FIG. 6 is a partial right-side elevational view of the writing instrument and hand tool grip of FIG. 2;

FIG. 7 is a partial left-side elevational view of the writing instrument and hand tool grip of FIG. 2 shown without a cutting blade;

DETAILED DESCRIPTION OF THE INVENTION

Figure 8:
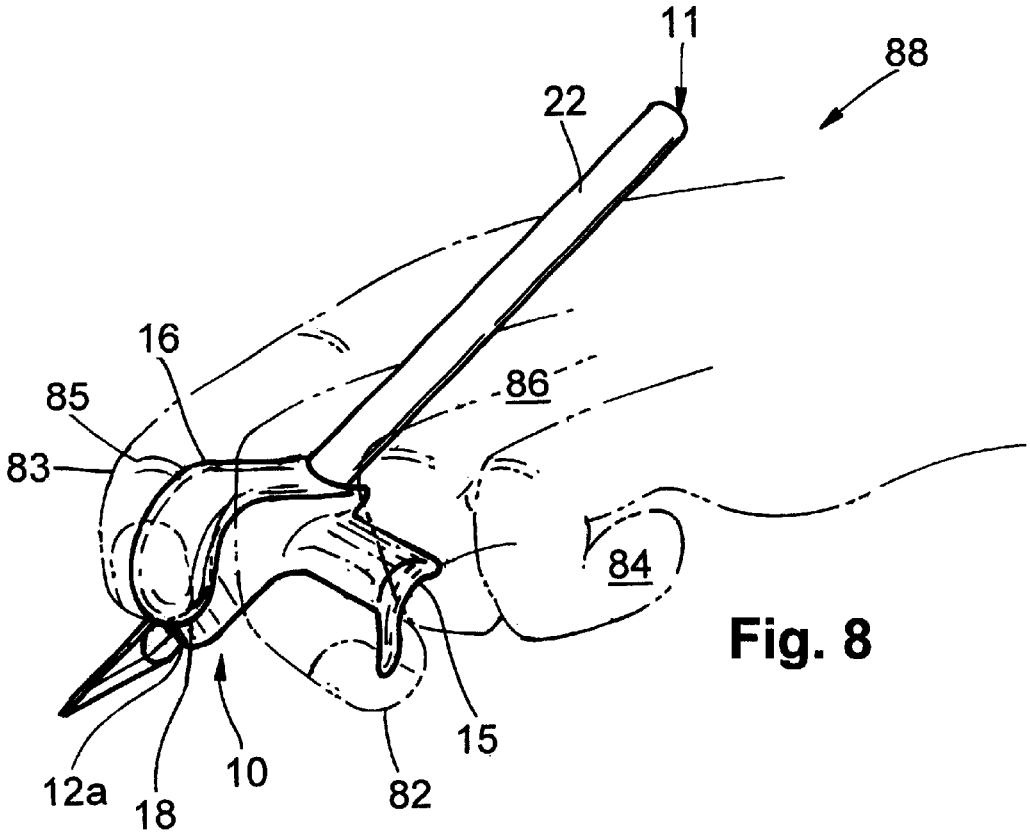
FIG. 8 is a left-side perspective view of the writing instrument and hand tool grip of FIG. 2 in use by a left-handed user according to the present invention.

Certain terminology is used in the following description for convenience only and is not limiting. The words "right," "left," "lower," and "upper" designate direction in the drawings to which reference is made. The words "inwardly" and "outwardly" refer to directions toward and away from, respectively, the geometric center of the writing instrument and hand tool grip and designated parts thereof. The terminology includes the words specifically mentioned above, derivatives thereof and words of similar import. As used herein, the word "a" as used in the claims means "at least one."

Referring now to the drawings in detail, wherein like numerals indicate like elements throughout, there is shown in FIGS. 1–9 a writing instrument and hand tool grip, generally designated 10, for receiving a hand-held instrument 11 according to the present invention. As will be apparent from the description below, the purpose of the grip 10 is to provide comfort to the manipulating hand of the user of the instrument 11 and absolute control of the instrument 11.

Referring now to FIGS. 1–7, the grip 10 includes a body 17 having a shaft-receiving portion 12 with an opening 12*a* defined therethrough adapted to receive the hand-held instrument 11. Typically, the opening 12*a* is a longitudinally extending, generally cylindrically shaped bore for receiving the hand-held instrument 11, which has a cylindrically shaped shaft 22. The cylindrical shape facilitates the sliding in and removal of the hand-held instrument 11. The shaft 22 extends from one end of the body 17 and is secured within the shaft-receiving portion 12 in a manner described in more detail below.

While the opening 12*a* is preferably cylindrically shaped, the opening 12*a* may be other shapes and sizes to accommodate hand-held instruments with differently shaped shafts (not shown). While the opening 12*a* can have various sizes, the opening 12*a* may be "a one size fits all" type. For example, the opening 12*a* could be enlarged and lined with a soft polymeric material (not shown) which expands to receive larger sized hand-held instruments and contracts to conform around smaller sized hand-held instruments. Additionally, the polymeric material provides retention functionality.

The body 17, and the remaining portions of the grip 10 described below, is preferably constructed of a lightweight high strength material, which is sufficiently heavy to provide additional "feel" when using the grip 10. More particularly, the body 17 is constructed of a metallic material such as brass, particularly when utilized with a xacto™ knife where the weight of the metal is beneficial for providing additional "feel" to the hand and control of the knife. The body 17, however, may be constructed of other materials, such as a lightweight polymeric material without departing from the spirit and scope of the present invention.

Referring now to FIG. 7, in the preferred embodiment, the shaft-receiving portion 12 is adapted to receive the shaft 22, which has an operative end in the form of a removable blade 25 at a distal end thereof such that the instrument is an xacto™ knife. The shaft 22 includes a threaded bore 22*a* in the end positioned within the shaft-receiving portion 12 for receiving a blade holder 24. The blade holder 24 has four expansion slots 24*a*, two of which receive the blade 25 at one end and a threaded shaft 24*b* at the opposite end. The blade holder 24 also includes a cam surface 24*c* that interacts with the end of the shaft 22 within the shaft-receiving portion 12. The threaded shaft 24*b* of the blade holder 24 is positioned within the threaded bore 22*a* until the cam surface 24*c* contacts the end of the shaft 22 which causes the expansion slots 24*a* to contract and hold the blade 25 in place, in a manner well understood by those of ordinary skill in the art.

It will be recognized by those of ordinary skill in the art from this disclosure that the present invention is not limited to any particular hand-held instrument 11. For instance, the hand-held instrument 11 could be a writing implement, highlighter, scalpel, laser or stylus (not shown).

The grip 10 also includes a forefinger grip 16 located above the shaft receiving portion 12. The forefinger grip 16 is convex from a proximal end 12*b* to a distal end 12*c* and projects outwardly from the shaft-receiving portion 12. The forefinger grip 16 is shaped to orient the forefinger outwardly and expand skin around the first joint of the forefinger as the hand-held instrument 11 is gripped. One advantage of the forefinger grip 16 is the provision of a surface for the natural shape of the forefinger. The natural shape of the forefinger is such that it is slightly curved toward the palm of the hand at the first joint of the forefinger. Hence, this portion of the forefinger rests naturally on the curved forefinger grip 16.

As best shown in FIGS. 5 and 6, the forefinger grip 16 further includes an indented forefinger support surface 18 located at the distal end 12*c* of the forefinger grip 16. The support surface 18 is generally concave to complement the convex contours of a tip of the forefinger. Thus, the forefinger bends around the forefinger grip 16 at the terminal joint of the forefinger while permitting the tip of the forefinger to rest in the complementarily shaped indented forefinger support surface 18. This allows a user to grip an instrument 11 in an ergonomic fashion.

Referring now to FIG. 5, an outward projecting lip 19 extends around the forefinger grip 16. The lip 19 extends from a thumb-side of the grip 10 continuously and around to a middle finger side of the body 17. The lip 19 is shaped to provide a contacting surface for that portion of the forefinger extending from the very first joint to the tip of the forefinger. The lip 19 provides the forefinger grip 16 with a generally U-shaped configuration in cross section. This allows the lateral sides of the forefinger to comfortably rest in the forefinger grip 16.

Figure 9:
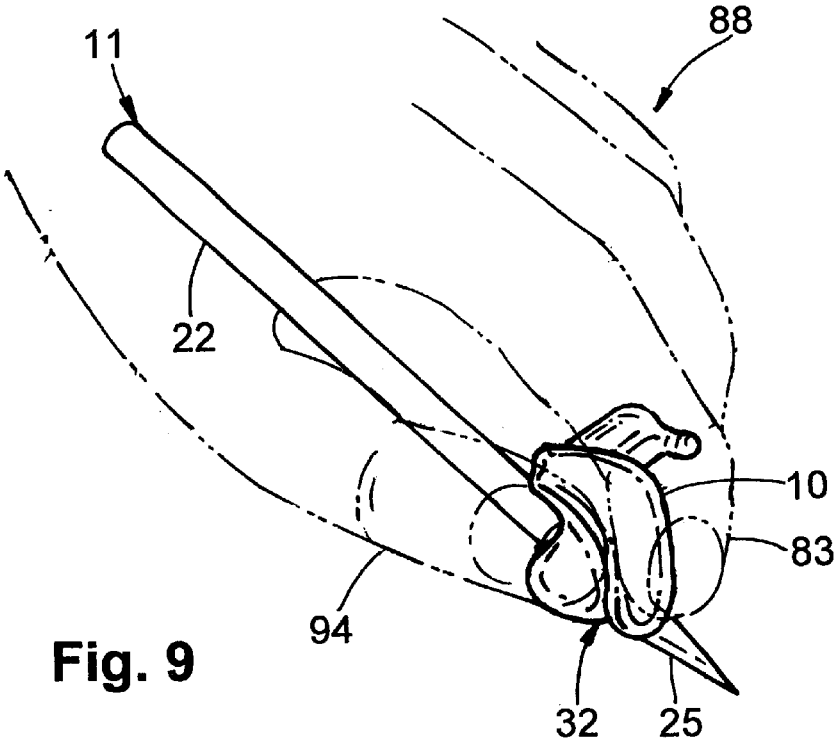
FIG. 9 is a right-side perspective view of the writing instrument and hand tool grip of FIG. 2 in use by a left-handed user according to the present invention.

Referring now to FIGS. 3, 5, 6 and 9, the grip 10 includes a thumb support surface 32, which is located on a thumb-side of the body 17. The thumb support surface 32 extends downwardly from an upper edge 16*a* of the forefinger grip 16. More particularly, the thumb support surface 32 is concave shaped and extends downwardly at an angle greater than ninety degrees from the upper edge 16*a* of the forefinger grip 16. The support surface 32 is located at least partially adjacent to the shaft-receiving portion 12. That is, the thumb support surface 32 extends inwardly from the upper edge 16*a* to the shaft receiving portion 12 to provide a comfortable place for the bottom tip of the thumb to rest, as best shown in FIGS. 5 and 9.

Referring now to FIGS. 1–5 and 7, the grip 10 also includes a middle finger grip 15. The middle finger grip 15 has proximal and distal ends 15*a*, 15*b*, respectively. The proximal end 15*a* is attached to a middle finger side of the body 17 and extends outwardly therefrom in a generally perpendicular direction. As best shown in FIGS. 1, 2 and 8, the middle finger grip 15 is curved to enable curling of a middle finger around the middle finger grip 15 as the grip 10 is held. The middle finger grip 15 includes a generally U-shaped portion 15*d* for receiving the middle finger in a complementary manner.

Referring now to FIGS. 8 and 9, the forefinger grip 16, middle finger grip 15 and the thumb support surface 32 are adapted for left handed gripping. However, one of ordinary skill in the art understands from this disclosure that the forefinger grip 16 and the thumb support surface 32 could be adapted for right handed gripping, without departing from the spirit and scope of the invention. A right handed grip would be a mirror image of the left handed grip 10. Accordingly, further description of the right handed grip 10 is omitted for purposes of brevity and is not limiting.

Referring now to FIG. 7, to secure the instrument 11 to the grip 10, the end of the shaft 22 with the threaded bore 22*a* is first slidably disposed through the opening 12*a* in the shaft-receiving portion 12 at the end closest to the proximal end 12*b* of the shaft receiving portion 12. The threaded shaft 24*b* of the blade holder 24, with the blade 25 in the blade holder 24, is positioned within opening 12*a* at the end closest the distal end 12*c* of the shaft-receiving portion 12 until it threadably contacts the threaded bore 22*a*. The shaft 22 and blade holder 24 are then rotated with respect to each other until the cam surface 24*c* contacts the end of the shaft 22 and contracts the expansion slots 24*a* around the blade 25 to secure the blade 25 therein. Because the exposed end of the blade holder 24 is larger than the opening 12*a*, securing the blade holder 24 to the shaft 22 also results in rotatably securing the instrument 11 to the body 17.

Referring now to FIG. 5, because the instrument 11 can be rotatably secured to the body 17, the blade 25 is securable in a particular angular position with respect to the body 17. Indicia 31, in the form of dash marks, are provided on the face of the distal portion 12*c* of the shaft-receiving portion 12 at 0, 30 and 45 degrees. Thus, the blade 25 can be readily fixed at a particular angle with respect to the body 17, thereby facilitating different types of consistent cuts, such as bevel cuts.

The grip 10 is preferably formed of a molding process, such as injection molding or casting, which is well known to those of ordinary skill in the art. Accordingly, a discussion of the exact molding process for forming the grip 10 is omitted for purposes of convenience only and is not limiting. While it is preferred that the grip 10 be formed by a molding process, it is understood by those with ordinary skill in the art from this disclosure, that the grip 10 could be constructed using other methods, such as by machining. Moreover, while it is preferred that the forefinger grip 16 and the body 17 be formed of a single piece by a molding process, the forefinger grip 16 may be formed by fixedly or removably attaching a separate piece to the body 17.

Referring now to FIGS. 8 and 9, in use the left-hand 88 drapes around the grip 10 in a position as illustrated. The forefinger 83 is positioned over the forefinger grip 16 such that the indented forefinger support surface 18 provides support to the tip of the forefinger 83. The middle finger 82 is curled around the middle finger grip 15 to provide additional control to the hand 88, while the two outermost fingers 84, 86 are tucked away toward the palm of the hand 88. Advantageously, as the instrument 11 is held the skin 85 around the first joint of the forefinger 83 is expanded to prevent the condition known as "bent finger" syndrome as previously discussed. As shown in FIG. 9, the thumb 94 rests on the thumb support surface 32 in a lateral position from the forefinger 83. The forefinger 83 is positioned above removable blade 25 to provide a wider range of control.

While the preferred embodiment grips an xacto knife, it is understood by those of ordinary skill in the art from this disclosure, that the present invention is not limited to any particular type of instrument 11. That is, while the grip 10 is described as being used with a two-piece instrument, unitary instruments (not shown), such as pencils, scalpel, laser, stylus or pens, could be used without departing from the spirit and scope of the invention. In the case of a unitary instrument, the shaft receiving portion 12 would be designed to hold the instrument in a secure fashion, such as with a setscrew or by friction (not shown).

Furthermore, while the preferred embodiment provides for the grip 10 and instrument 11 being separate, it is understood by those of ordinary skill in the art that the grip 10 and instrument 11 could be integrally formed as a single piece, without departing from the spirit and scope of the invention. In this case, the body 17 has the shaft 22 of the hand-held instrument 11 extending from one end of the body 17 and an operative end of the hand-held instrument extending from the opposite end of the body 17.

While the grip 10 preferably is of a one-size fits all design, those of ordinary skill in the art understand that different size grips could be provided for different size hands.

The front of the body 17 where the blade 25 extends may include indicia, such line markings (not shown), which identify the relative orientation of the blade 25 with respect to body 17 to provide the user with an indication of the vertical centering of the blade 25.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. A writing instrument and hand tool grip for receiving a hand-held instrument, comprising:

a body having a shaft-receiving portion with an opening defined therethrough adapted to receive the hand-held instrument;

a forefinger grip located above the shaft receiving portion, the forefinger grip being convex from a proximal end to a distal end and projecting outwardly from the shaft receiving portion, the forefinger grip being shaped to orient a forefinger outwardly and expand skin around a first joint of the forefinger as the hand-held instrument is gripped; and a thumb support surface located on a thumb side of the body, the thumb support surface extending downwardly from an upper edge of the forefinger grip.

2. The writing instrument and hand tool grip according to claim 1 wherein the forefinger grip further comprises an indented forefinger support surface located at the distal end of the forefinger grip, the support surface is generally concave to complement the generally convex contours of a tip of the forefinger.

3. The writing instrument and hand tool grip according to claim 1 further comprising a middle-finger grip having proximal and distal ends, the proximal end being attached to a middle-finger side of the body, the middle-finger grip being curved to enable curling of a middle finger around the middle finger grip as the hand-held instrument is gripped.

4. The writing instrument and hand tool grip according to claim 3 wherein the middle finger grip includes a generally U-shaped portion for receiving a middle finger in a complementary manner.

5. The writing instrument and hand tool grip according to claim 1 wherein the shaft-receiving portion is adapted to receive a shaft having a removable blade at a distal end thereof.

6. The writing instrument and hand tool grip according to claim 1 further comprising an outward projecting lip extending around the forefinger grip, the lip extending from the thumb side continuously and around toward a middle-finger side of the body, the lip being shaped to provide a contacting surface for that portion of the forefinger extending from the first joint towards a tip of the forefinger.

7. The writing instrument and hand tool grip according to claim 1 wherein the forefinger grip and the thumb support surface are adapted for left handed gripping.

8. The writing instrument and hand tool grip according to claim 1 wherein the thumb support surface is convex shaped and extends downwardly at an angle greater than ninety degrees from the upper edge of the forefinger grip, the support surface being located at least partially adjacent to the shaft receiving portion.

9. A combination hand-held instrument and grip, comprising:

a body having a shaft of a hand-held instrument extending from one end and an operative end of the hand-held instrument extending from an opposite end of the body;

a forefinger grip located above the shaft, the forefinger grip being convex from a proximal end to a distal end and projecting outwardly from the shaft, the forefinger grip being shaped to orient a forefinger outwardly and expand skin around a first joint of the forefinger as the hand-held instrument is gripped; and a thumb support surface located on a thumb side of the body, the thumb support surface extending downwardly from an upper edge of the forefinger grip.

10. The combination hand-held instrument and grip according to claim 9 wherein the forefinger grip further comprises an indented forefinger support surface located at the distal end of the forefinger grip, the support surface is generally concave to complement the generally convex contours of a tip of the forefinger.

11. The combination hand-held instrument and grip according to claim 9 further comprising a middle-finger grip having proximal and distal ends, the proximal end being attached to a middle-finger side of the body, the middle-finger grip being curved to enable curling of a middle finger around the middle finger grip as the hand-held instrument is gripped.

12. The combination hand-held instrument and grip according to claim 11 wherein the middle finger grip includes a generally U-shaped portion for receiving a middle finger in a complementary manner.

13. The combination hand-held instrument and grip according to claim 9 wherein the operative end includes a removable blade.

14. The combination hand-held instrument and grip according to claim 9 further comprising an outward projecting lip extending around the forefinger grip, the lip extending from the thumb side continuously and around toward a middlefinger side of the body, the lip being shaped to provide a contacting surface for that portion of the forefinger extending from the first joint towards a tip of the forefinger.

15. The combination hand-held instrument and grip according to claim 9 wherein the forefinger grip and the thumb support surface are adapted for left handed gripping.

16. The combination hand-held instrument and grip according to claim 9 wherein the thumb support surface is concave shaped and extends downwardly at an angle greater than ninety degrees from the upper edge of the forefinger grip, the support surface being located at least partially adjacent to the shaft.

* * * * *